United States Patent [19]

Aelterman et al.

[11] 4,002,267

[45] Jan. 11, 1977

[54] METHOD AND APPARATUS FOR PREPARING PHOTOPROCESSING SOLUTIONS, AND THE LIKE

[75] Inventors: Marcel Aelterman, Mortsel; Gustaaf De Loucker, Berchem; Leo Van Bouwel, Mortsel; Emile Stievenart, Mortsel; Horst Köninger, Munich; Helmut Schausberger, Unterhaching; Franz Ertl, Munich; Horst Röhr, Garching; Erwin Geyken, Munich, all of Germany

[73] Assignee: AGFA-Gevaert AG, Leverkusen, Germany

[22] Filed: May 8, 1974

[21] Appl. No.: 468,170

[30] Foreign Application Priority Data

May 8, 1973 Germany ..... 2323160

[52] U.S. Cl. ..... 222/1; 222/57; 222/145

[51] Int. Cl.[2] ..... B67D 5/14

[58] Field of Search ..... 222/59, 64, 65, 88, 222/145, 193, 129, 4, 1, 57, 66; 23/271 R, 271 G, 272.8, 272.7; 354/323, 324; 137/268, 572

[56] References Cited

UNITED STATES PATENTS

| | | | |
|---|---|---|---|
| 2,655,286 | 10/1953 | Barbaro | 222/88 X |
| 2,802,599 | 8/1957 | Callahan et al. | 222/129.4 X |
| 2,946,488 | 6/1960 | Kraft | 222/145 X |
| 2,952,209 | 9/1960 | Scholin | 222/66 X |
| 3,166,096 | 1/1965 | Lang | 23/272.8 |
| 3,268,119 | 8/1966 | Kopera | 222/145 |
| 3,607,105 | 9/1971 | Reid et al. | 222/193 |
| 3,841,351 | 10/1974 | Shida | 354/324 |
| 3,877,682 | 4/1975 | Moss | 222/145 X |

FOREIGN PATENTS OR APPLICATIONS

| | | | |
|---|---|---|---|
| 606,571 | 6/1926 | France | 222/145 |

*Primary Examiner*—Allen N. Knowles
*Assistant Examiner*—Hadd Lane
*Attorney, Agent, or Firm*—Michael J. Striker

[57] ABSTRACT

A method of mixing at least one chemical concentrate with a thinning fluid to form a predetermined amount of a mixture or solution having a predetermined composition, particularly for use in photographic processing operations. Predetermined amounts of the concentrates are placed into respective holding units. The contents of the holding units are emptied into a mixing conduit which leads to a supply tank while at the same time thinning fluid is passed through the mixing conduit. The flow of thinning fluid through the mixing conduit is terminated when the amount of thinning fluid which has been passed through the mixing conduit reaches the amount corresponding to the predetermined amounts of the initial concentrates and to the predetermined amount of final solution or mixture desired.

48 Claims, 10 Drawing Figures

METHOD AND APPARATUS FOR PREPARING PHOTOPROCESSING SOLUTIONS, AND THE LIKE

BACKGROUND OF THE INVENTION

The invention relates to a method and an apparatus for mixing one or more chemical concentrates, especially concentrates of photographic processing fluids, with an amount of thinning fluid, especially water, such as will impart a desired concentration to the mixture.

In professional photographic developing installations, it has begun to be the case that the photographic processing fluids are no longer supplied in powdered form to be mixed in by the user of the apparatus; instead, us is made of cannisters filled with predetermined amounts of fuid concentrates. The concentrates are mixed together in predetermined ratios and diluted with a predetermined amount of water, in order to obtain a properly diluted processing or regenerating solution. Regenerating solutions are more strongly concentrated than processing solutions, and in dependence upon the processing solution used are subsequently introduced into the processing container. This is done, for example, by means of a dosing pump operative for introducing into the processing tank an amount of regenerating solution corresponding to the surface area of the photographic material being processed.

In the past, the concentrates were all poured into a suitable tank and then diluted with a corresponding amount of water, the solution being vigorously stirred and then pumped into a supply tank. This manner of mixing and diluting chemical concentrates is relatively tedious and creates the possibility of operating mistakes.

SUMMARY OF THE INVENTION

It is accordingly a general object of the invention to provide a method and arrangement for the preparation of photographic processing baths, and the like, simpler than what is known from the prior art and of such a character as to largely preclude the possibility of error upon the part of the operator of the arrangement.

This object, and others which will become more understandable from the following description of specific embodiments, can be met, according to one exemplary concept of the invention, by preparing a certain amount of concentrate or concentrates, passing the concentrates through a conduit leading to the supply tank, and also passing through such conduit a diluting fluid, the passage of diluting fluid through such conduit being terminated when the amount of such diluting fluid which has passed through the conduit reaches a predetermined value corresponding to the amount of concentrate or concentrates.

Passage of the concentrates through a mixing conduit through which is also passing the thinning fluid results in so thorough an intermixing and blending, that the mixture can be introduced directly into the supply tank. By measuring or dosing the amount of thinning fluid, errors on the part of the operator of the arrangement are to a very great extent precluded The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
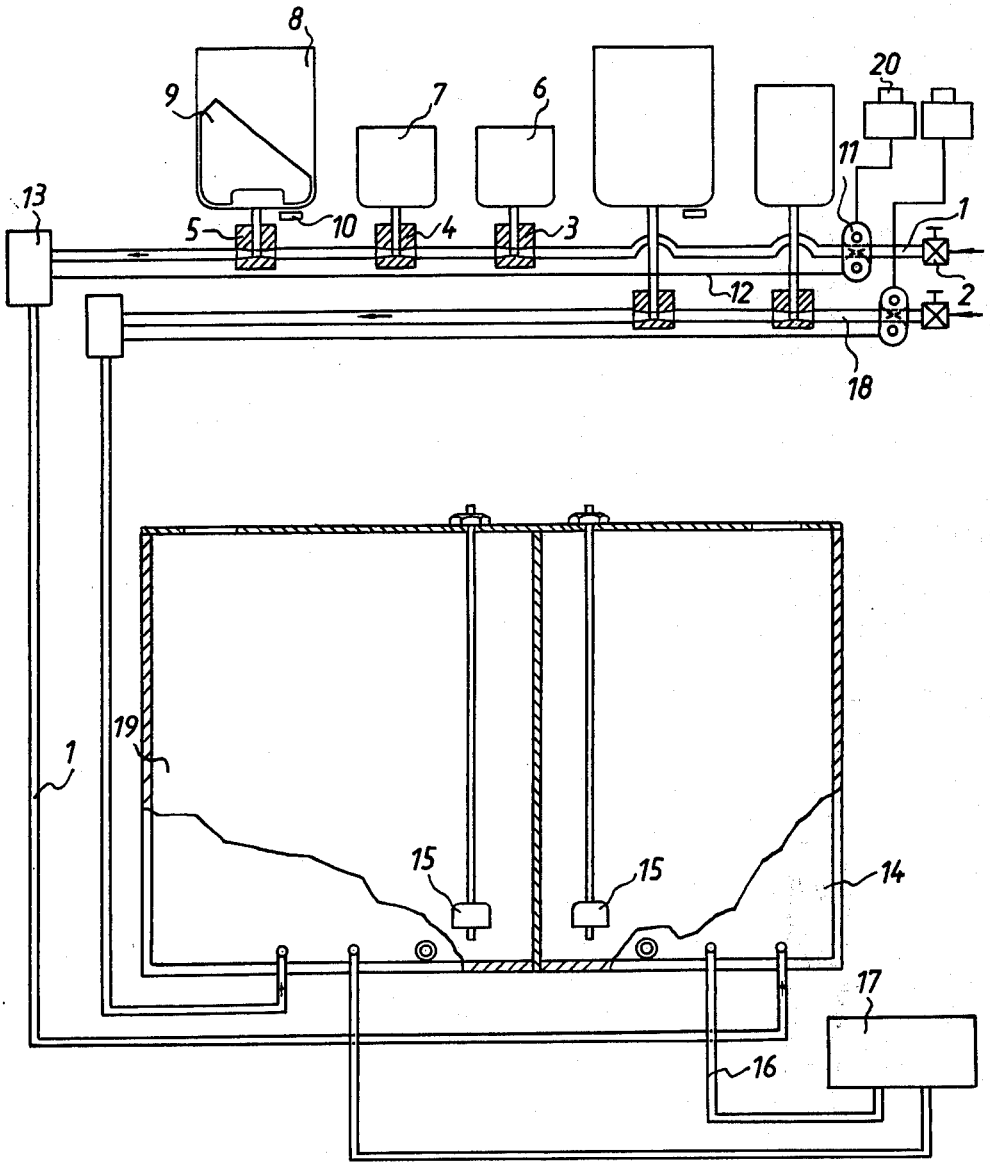
FIG. 1 depicts one mixing arrangement according to the invention, provided with a volumetric flow measuring device for measuring flow in the thinning fluid supply conduit.

FIG. 1 depicts a first apparatus according to the invention. Reference numeral 1 designates a thinning fluid conduit which is connected at its right end (as seen in FIG. 1) to a non-illustrated source of thinning fluid, for example, a water pipe network. Connected in the thinning fluid conduit 1 is an adjustable pressure-reducing valve. If desired, upstream provision can also be made of means for preventing backflow and of pipe venting means.

The arrangement of FIG. 1 includes three T-members 3, 4, 5. Each of these T-members is comprised of a constricted horizontal conduit portion forming part of thinning fluid conduit 1, and is further comprised of a vertical conduit portion having a lower end opening into the constricted conduit portion and having an upper end opening into a respective one of three holding units 6, 7, 8. The holding units 6, 7, 8 are each configurated in the form of a large can-shaped container having an open top. These holding units 6, 7, 8 are adapted to receive cans or containers filled with predetermined amounts of concentrate, and accordingly the dimensions of the holding units 6, 7, 8 are made to correspond to the dimensions of the containers which they are to accommodate. In the present instance, the three holding units 6, 7 and 8 will hold respective ones of three concentrate-containing cans of different size. The concentrates in these cans will be the concentrates which are to be mixed together and mixed with the thinning fluid to form a developer solution of predetermined concentration, and the ratios of the volumes of concentrate contained in such three cans will stand in proportion to the desired ratio of concentration of the concentrates in the final developer solution.

Holding unit 8, which itself constitutes a container open at the top and communicating with the vertical conduit of T-member 5 at the bottom, is shown in FIG. 1 provided with a knife member 9. When the associated can of concentrate is dropped into holding unit 8 and then pushed down, the bottom of the can, which may, for example, be of plastic, is cut open by the knife 9, so as to permit a free flow of fluid out of such can and into the holding container 8. The other holding units 6 and 7 can be provided with similar can-opening knives.

At least the holding unit 8 is provided with a microswitch arrangement 10, schematically depicted in FIG. 1 and per se of very well known construction; the microswitch arrangement 10 is operative for detecting the presence of a can of concentrate in the holding unit 8 and for generating a corresponding signal which is furnished to a control arrangement described further below.

Inside each of the T-members 3, 4, 5 there is further provided a check valve arranged in the vertical conduit portion of the T-member and operative for permitting fluid flow when the fluid pressure above the check valve is higher than that below the check valve, and for accordingly preventing fluid flow when the pressure above the check valve is less than the pressure below the check valve. In this way it is assured that thinning fluid in conduit 1 is not drawn up into the holding units 6, 7, 8.

Connected in the flow path of conduit 1 there is a measuring arrangement 11 for determining the total volume of thinning fluid flowing from the source of thinning fluid through the conduit 1 and in particular through the measuring arrangement 11 arranged in the flow path of conduit 1. Measuring arrangement 11 may, for example, comprise two meshing gears rotated by fluid flowing through the region where the gears mesh. The output shaft of such flowmeter can be provided with a pulse-generating unit of conventional design, for example, a magnet on the drive shaft and a stationary Hall generator detector positioned in operative proximity thereto and operative for generating one pulse per rotation of the flowmeter output shaft. The total number of such pulses generated constitutes an indication of the total volume of thinning fluid which has passed through the flowmeter. The generated pulses are applied to a resettable counter arrangement at whose output there appears a signal indicative of the total number of pulses counted. Connected to the counter output may be one input of a comparator, the other input of the comparator being connected to an arrangement for selecting a signal having a value equal to a desired number of pulses to be counted by the counter arrangement. The output of the comparator (for example a Schmitt trigger) is, for example, connected by conductor 12 to the solenoid in solenoid valve 13. When the two signals applied to the two comparator inputs are unequal, the comparator generates an output voltage which energizes the solenoid of solenoid valve 13, thereby opening the solenoid valve and permitting fluid flow through conduit 1. When the two signals applied to the two comparator inputs are equal, the comparator generates an output voltage which no longer energizes the solenoid of solenoid valve 13, thereby causing the solenoid valve 13 to close and prevent further fluid flow through conduit 1. When pushbutton 20 is depressed, it applies to the counter a reset pulse, resetting the counter to zero. The conduit 1 proceeds in downwards and downstream direction away from the magnet valve 13 to the supply tank 14, entering the latter at the bottom thereof. Arranged in the supply tank 14 is a float switch 15 operative for detecting when the liquid level falls below a predetermined level and operative for generating a signal when this occurs. Also communicating with the interior of the supply tank 14 is a conduit 16 which leads to a dosing pump 17. The dosing pump supplies measured amounts of processing fluid to the processing tank, the dosed amount being the amount necessary to process the photographic material in the non-illustrated processing tank.

Running alongside the fluid conduit 1 for the thinning fluid for the developer concentrates, there is a similar conduit 18 for the thinning fluid for the fixing fluid concentrates. The thinning of the fixing fluid concentrates, which are stored in cans accommodated in the two additional holding units shown in FIG. 1, by means of the thinning fluid supplied into conduit 18, is completely analogous to the thinning of the developer concentrates, and accordingly need not be separately described. It is noted that the properly diluted fixing fluid concentrates are delivered into a second supply tank 19, which also communicates with the dosing pump 17.

The operation of the apparatus shown in FIG. 1 is as follows:

If the liquid level in the supply tank 14 falls below the level associated with the level-detecting arrangement 15, the latter generates a signal indicating that addition of developer fluid to the supply tank 14 is necessary. The operator of the apparatus inserts cans of concentrates into the holding units 6, 7, 8. The cans are pushed down against either the knife member 9 shown in FIG. 1 or against the hollow can-punching member shown in FIG. 10, to thereby puncture the concentrate-containing cans.

The start button 20 is pressed, thereby resetting the counting arrangement in the measuring arrangement 11. As a further result of pressing the start button 20, the electromagnetic valve 13 opens and the pump in the measuring arrangement 11 pumps thinning fluid through the conduit 1. The water pressure in the constricted portions of the conduit 1, namely in the portions of conduit 1 passing through the T-members 3, 4, 5, decreases until finally the check valves in the T-members 3, 4, 5 open, permitting the sucking of concentrate out of the respective holding units 6, 7, 8 into the thinning fluid conduit 1. The constricted portions of conduit 1 are regions not only of reduced pressure but also of increased flow velocity, and the introduction of the concentrates into the conduit 1 at these points results in a particularly intensive mixing action. The length of the flow path of conduit 1 adds further to the intensiveness of the mixing action.

The measuring arrangement 11 operates as described above. When the preselected volume of water has passed through the measuring arrangement 11, the valve-opening signal on line 12, which is applied to magnet valve 13, terminates thereby causing the latter to close, and thereby terminating the flow of thinning fluid. The flow velocity of the thinning fluid can be selected by adjusting the setting of the pressure reducing valve 2, or in other known manner. The flow velocity of the thinning fluid is advantageously so selected that the holding units 6, 7, 8 and the cans accommodated therein will have been completely emptied of developer concentrate prior to the automatic termination of flow of thinning fluid through conduit 1.

Since the diluted concentrates enter the supply tank 14 at the bottom thereof, the mixture contained therein will be maintained in motion so long as fluid continues to enter. Accordingly, even at the end of the filling-up of the tank 14, when only thinning fluid is entering the tank 14 through the bottom thereof, a substantial degree of mixing action is still occurring, so that the concentration of the mixture in the supply tank 14 will ultimately be homogeneous.

Figure 2:
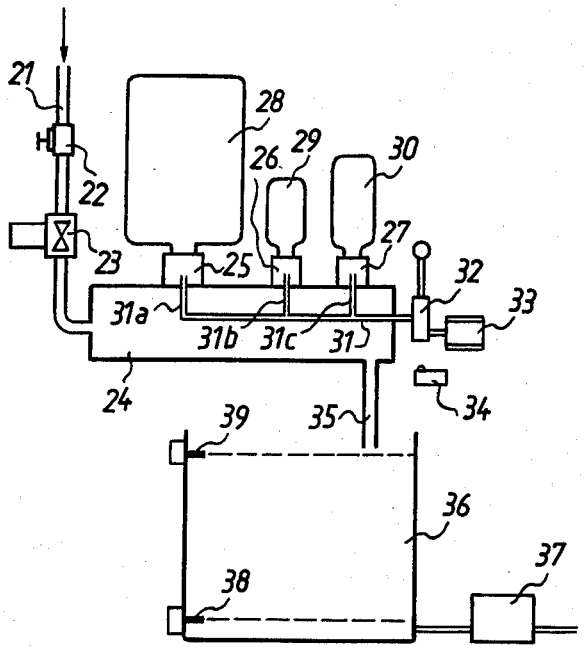
FIG. 2 depicts a mixing arrangement in which the measurement of the amount of thinning fluid introduced is performed indirectly by measuring the amount of the final mixture in the supply tank.

FIG. 2 depicts a modification of the apparatus shown in FIG. 1. Here, the measuring arrangement 11 of FIG. 1, which was operative for measuring the total volume of the thinning fluid, is replaced by an arrangement for measuring the volume of the mixture in the supply tank. Specifically, the measuring arrangement of FIG. 2 comprises two level-detecting switches 39, 38 respectively associated with a higher and with a lower liquid level. The mixture in the supply tank which results from emptying of the concentrate-containing bottles and addition of the proper amount of thinning fluid is maintained at a liquid level intermediate the just-mentioned higher and lower liquid levels.

Specifically, the arragnement is constructed as follows. A fresh water conduit 21 empties, via a pressure-regulating valve 22 and an electromagnetically actuated valve 23, into a mixing pipe 24 of substantially larger diameter.

Three bottle supports 25, 26, 27 are provided. Concentrate-containing bottles 28, 29, 30 are inverted, and their neck portions are inserted into the bottle supports 25, 26, 27, the bottles being supported by the bottle supports in such inverted position. The openings at the bottoms of the bottle necks are sealed by means of a thin foil which can be easily pierced. Inside the mixing pipe 24 there is provided an arm 31 which carries three piercing members 31*a*, 31*b*, 31*c*; the arm 31 can be moved upwards to the illustrated position so as to cause the piercing members 31*a*, 31*b*, 31*c* to pierce the sealing foils of the bottles 28, 29, 30, thereby permitting emptying of the contents of the bottles.

Specifically, arm 31 is moved by means of a spring-biased lever arrangement 32 (somewhat schematically depicted). The arm 31 and lever 32 are mounted by non-illustrated mounting means for upwards and downwards movement between an illustrated upper position, in which the piercing members 31*a*, 31*b*, 31*c* penetrate into the bottle supports 25, 26, 27, and a lower position, in which the piercing members 31*a*, 31*b*, 31*c* are retracted so as not to pierce the seals of bottles 28, 29, 30. The lever 32 cooperates with an electromagnetically releasable cocking arrangement 33 and a microswitch 34.

Specifically, the lever 32, the support arm 31, and the piercing elements 31*a*, 31*b*, 31*c* will initially be in their illustrated upper position. The lever 32 is plunged downwards against the force of non-illustrated biasing means, until it activates double-pole double-throw microswitch 34. When the lever 32 is thusly moved downwards, the support arm 31 moves downwards, and the piercing elements 31*a*, 31*b*, 31*c* retract downwards out of the bottle supports 25, 26, 27. When the lever 32 is pushed downwards in the manner just mentioned, the leftwardly projecting latch member of electromagnetic latch 33 slips in leftwards direction over the top of the lever 32, thereby latching or cocking the lever 32 in the lowered position thereof. If the electromagnetic winding of the electromagnetic latch 33 should become energized, the latch member is retracted rightwards, thereby releasing the cocked lever 32 which is then pushed upwards by the non-illustrated biasing means, and the piercing members accordingly return to their illustrated upper or piercing positions.

The mixing pipe 24 empties into an outlet conduit 35, which in turn leads to the supply tank 36, the supply tank 36 being in turn connected to a dosing pump 37. Inside the supply tank 36 there are arranged a lower level-detecting switch 38 and an upper level-detecting switch 39, these level-detecting switches close thereby generating signals when the liquid level in the supply tank 36 falls below the level associated with the respective switch. Such level-detecting switches are known per se.

Figure 3:
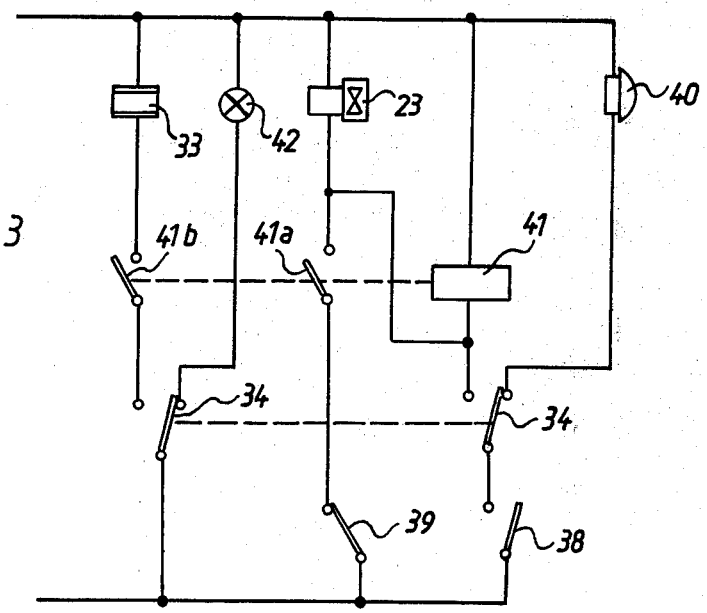
FIG. 3 depicts a circuit for use in controlling the operation of the apparatus shown in FIG. 2.

FIG. 3 depicts a circuit arrangement for the control of the apparatus depicted in FIG. 2. The elements of FIG. 2 which are depicted in FIG. 3 are identified by the same reference numeral. When the switch 38 is closed and the right-hand switch member is closed, then these switch members are connected in series with an alarm unit 40. On the other hand, if the right-hand switch member 34 is in the non-illustrated position thereof, this switch member and the switch 38 will be connected in series with the relay winding 41, energizing the latter. When relay 41 is energized, the relay switches 41*a*, 41*b* close; these two switches when closed are respectively connected in series with the winding of electromagnetically actuated valve 23 and with the latch electromagnet 33. The left-hand switch member of the microswitch 34 when in the illustrated rest position thereof closes the current path of an indicator lamp 42; in its operative position it energizes the electromagnet 33, if switch 41*b* is in the closed position.

In rest condition, all of the switches in FIG. 3 assume their illustrated positions. Upon the termination of a mixing operation, the operator of the apparatus of FIG. 2 replaces the emptied bottles 28, 29, 30 with full bottles 28, 29, 30. The operator also moves the lever 32 until the latter trips the switch 34, so that the switch members 34 shown in FIG. 3 move to their non-illustrated positions. The latch controlled by electromagnet 33 maintains the lever 32 in this lowered position. Now if, as a result of drawing of fluid out of the supply tank 36, the liquid level in 36 is so low as to activate switch 38, then the latter closes, thereby energizing relay winding 41, which in turn effects closing of the two relay switches 41*a*, 41*b*. As a result, the magnet valve 23 and the electromagnet 33 become energized. Accordingly, the magnet valve opens and thinning fluid flows through the mixing pipe 24 into the supply tank 36. Simultaneously, the magnet 33 releases the lever 32. As a result, the biasing means for the lever 32 causes the latter to move upwards, carrying with it the arm 31, and thereby causing the puncturing members 31*a*, 31*b*, 31*c* to puncture the sealing foils of the newly furnished full bottles 28, 29, 30, and the contents of these bottles now flows into the mixing pipe 24. As a result, there occurs in the mixing pipe 24 an intensive mixing of the thinning liquid (water) with the three developer components. The flow velocity of the water is advantageously adjusted by means of the pressure control valve 22 to such a valve that the time required for the necessary volume of water to pass through the mixing pipe 24 is at least 150% the time required for all three of the bottles 28, 29, 30 to be emptied. Accordingly, after the bottles 28, 29, 30 have all become empty, water continues to flow through the mixing pipe 24, until the level of liquid in the supply tank 36 reaches the level of the switch 39. Of course, long before this, the level-detecting switch 38 has reopened, namely at the beginning of the mixing operation, so that the relay winding 41 is now being supplied with energizing current via the closed switches 39, 41*a*.

When the liquid level in the tank 36 rises to a height which again opens the level-responsive switch 39, the relay winding 41 becomes deenergized and the magnet valve 23 closes. The deenergization of magnet 33, as a result of the opening of normally open switch 41*b*, makes possible a new cocking or latching of the lever 42, i.e., when next the lever 32 is pushed down against the force of its non-illustrated biasing spring, the latch member controlled by electromagnet 33 will again slip over the lever 42 maintaining lever 42 in the lowered position in which the piercing members 31*a*, 31*b*, 31*c* are in their retracted non-piercing positions and in which the switch members 34 are in their non-illustrated position. However, until such re-cocking or relatching action occurs, the switch members 34 remain in their illustrated positions. However, when the operator of the apparatus desired to replace the emptied bottles with full bottles, he must thusly depress the lever 32 so as to cock the lever, in order to move the piercing members 31*a*, 31*b*, 31*c* to their non-piercing positions, so that the sealing foils of the newly inserted full bottles 28, 29, 30 will not be pierced until such time as the liquid level in tank 36 again falls below the level associated with switch 38.

Figure 4:
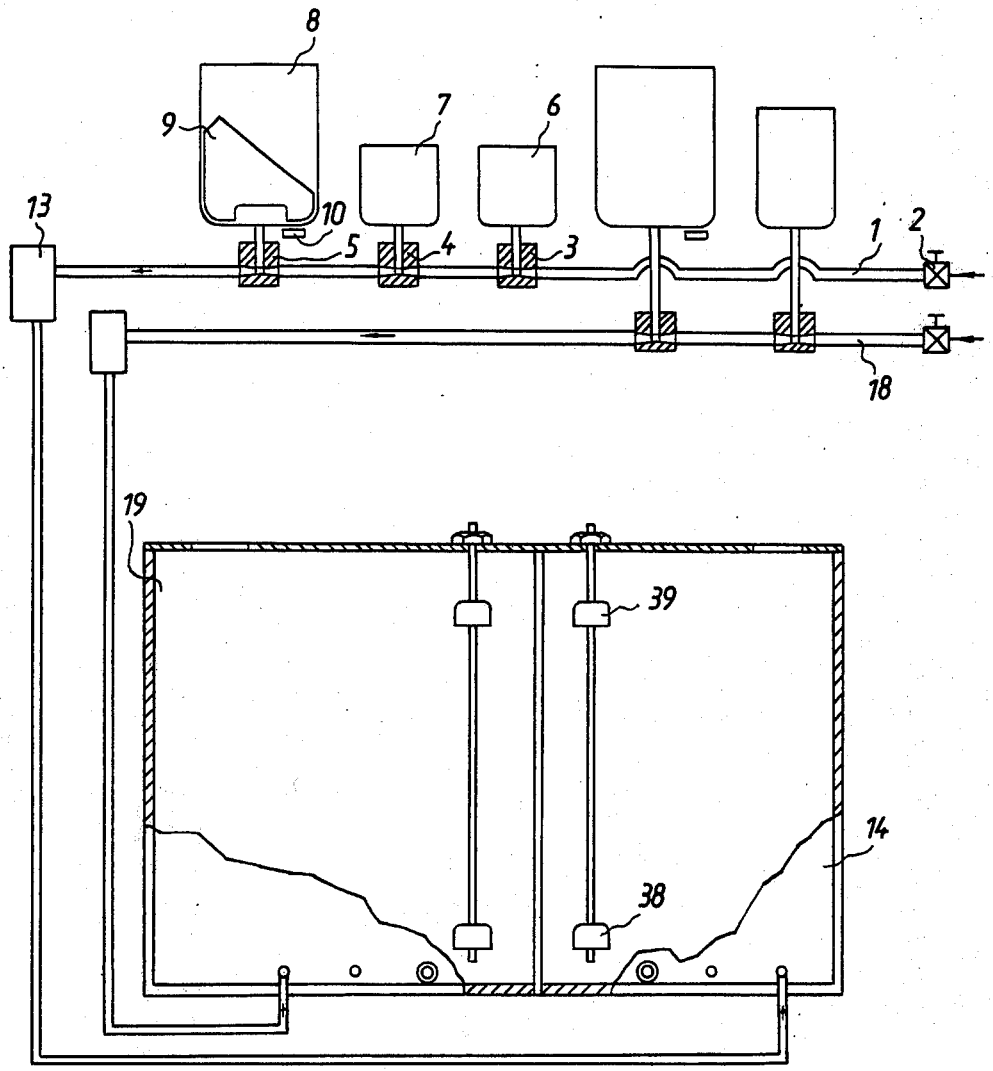
FIG. 4 depicts an apparatus wherein the concentrates are drawn out of their respective tanks under the force of suction resulting from the flow of thinning fluid past such tanks.

FIG. 4 depicts a further mixing apparatus of the invention, bearing a strong resemblance to the mixing apparatus of FIG. 1. Instead of the measuring arrangement of FIG. 1 which is operative for measuring the total volumetric flow of thinning fluid, the apparatus of FIG. 4 employs lower and upper level-responsive switches 38, 39 inside the supply tank 14, for the indirect measurement of the amount of thinning fluid, according to the principle of operation explained with respect to FIG. 2. The structural components which are identical to those of FIG. 1 apparatus are designated by the same reference numerals as employed in FIG. 1.

Figure 6:
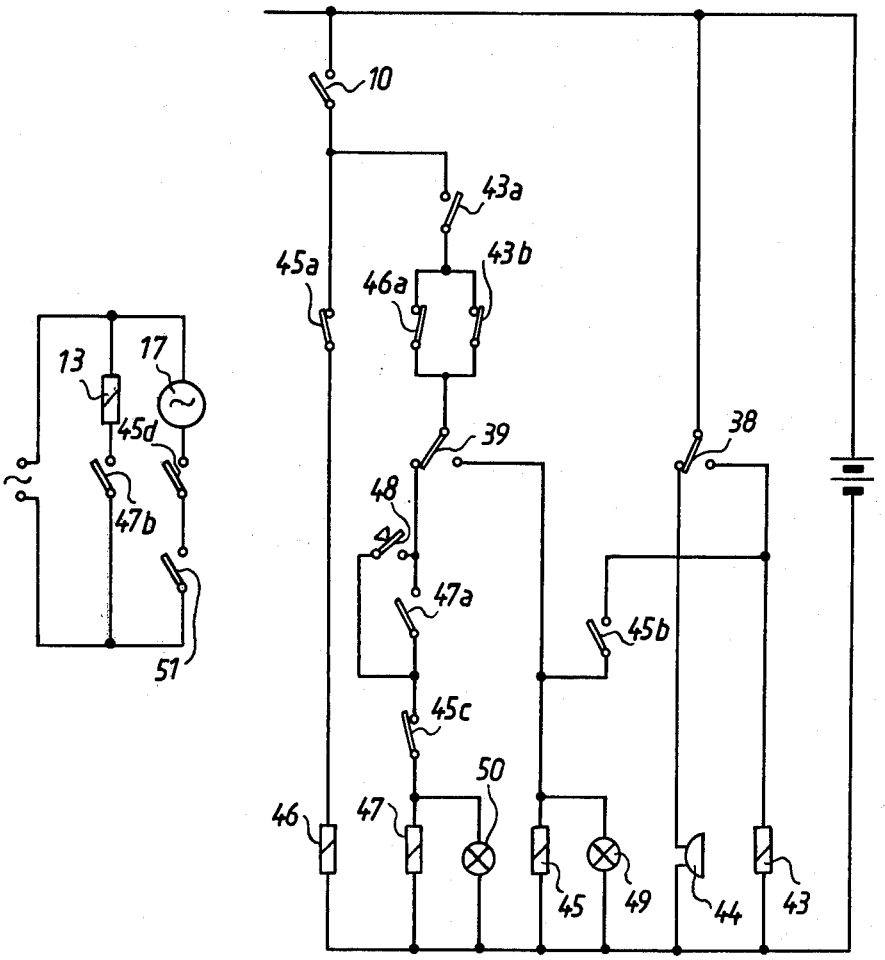
FIG. 6 depicts a circuit for the control of the apparatuses depicted in FIGS. 4 and 5.

FIG. 6 depicts a control circuit for the control of the mixing apparatus depicted in FIG. 4. The circuit includes a first relay winding 43. When relay winding 43 is unenergized, the associated relay switch 43*a* occupies its illustrated open position, and the associated relay switch 43*b* occupies its illustrated closed position. When relay winding 43 becomes energized, the associated relay switches 43*a*, 43*b* assume their non-illustrated positions.

Level-responsive switch 38 occupies its illustrated position, energizing alarm 44, when the liquid level in the supply tank 14 is below the level associated with switch 38.

Level-responsive switch 38 moves to its other position, thereby energizing winding 43, when the liquid level in the supply tank 14 is above the level associated with switch 38.

The control circuit of FIG. 6 includes a second relay winding 45. When winding 45 is unenergized, the associated relay switches 45*a* and 45*c* occupy their illustrated closed position and the associated relay switches 45*b* and 45*d* occupy their illustrated open position. Conversely, when winding 45 becomes energized, the associated relay switches 45*a*, 45*b*, 45*c*, 45*d* assume their non-illustrated positions.

The FIG. 6 circuit also incudes the upper level-responsive switch 39. When the liquid level in supply tank 14 is below the level associated with switch 39, switch 39 occupies its illustrated position.

When the liquid level in supply tank 14 is above the level associated with switch 39, switch 39 occupies the other position thereof.

The FIG. 6 circuit further includes the microswitch 10. Microswitch 10 is associated with the container-holding unit 8. If a container is accommodated within the holding unit 8, microswitch 10 is closed; if no container is accommodated within the holding unit 8, microswitch 10 is open.

The circuit further includes a relay winding 46 connected in series with the relay switch 45*a*. When relay winding 46 is unenergized, the associated relay switch 46*a* is closed. When relay winding 46 becomes energized, the switch 46 opens.

The control circuit further includes a relay winding 47, associated with relay switches 47*a*, 47*b*. When winding 47 is unenergized, switches 47*a*, 47*b* occupy their illustrated positions; when winding 47 is energized, switches 47*a*, 47*b* occupy their non-illustrated positions.

Reference numeral 48 designates a momentary switch activated by briefly depressing a pushbutton. Switch 48 is shunted by relay switch 47*a* which has a self-locking action described below.

Reference numerals 49 and 50 designate indicator lamps respectively connected in parallel with the relay windings 45 and 47.

Reference numeral 17 designates the dosing pump depicted in FIG. 4.

Reference numeral 13 designates the electromagnetically actuatable valve depicted in FIG. 4. When energized, valve 13 opens; when deenergized, valve 13 closes.

Reference numeral 51 designates a manually activatable switch which when closed inititates operation of the pump 17, provided that the relay switch 45*d* is closed.

The right-hand portion of the circuitry of FIG. 6 is supplied by a source of relatively low D.C. voltage, whereas the left-hand portion of the circuitry of FIG. 6 is supplied by a relatively high voltage, for example, derived from the electric mains.

The operation of the control circuit depicted in FIG. 6, and its interrelationship with the controlled apparatus of FIG. 4, is as follows:

1. It is assumed that the supply tank 14 is empty, that all switches are in their respective illustrated positions, and that all relay windings are unenergized.

2. A concentrate-containing container is inserted into the holding unit 8, thereby causing microswitch 10 to close.

3. As a result, the relay winding 46 becomes energized.

4. Since the supply tank 14 is altogether empty, the liquid level is evidently below the level associated with lower level-responsive switch 38. This is why switch 38 occupies the illustrated position thereof, energizing the alarm 44.

5. Under these circumstances, automatic mixing together of the concentrates and thinner cannot be immediately initiated. Instead, developer fluid which has been prepared by mixing the concentrates and thinner together in the correct proportions outside the mixing apparatus is now poured into the supply tank 14 until the liquid level in tank 14 reaches the level associated with switch 38.

6. Accordingly , switch 38 assumes its non-illustrated position, deenergizing alarm 44, and energizing relay winding 43.

7. The relay switches 43*a*, 43*b* accordingly assume their non-illustrated positions, and the mixing apparatus is now ready to be activated.

8. The pushbutton-controlled momentary switch 48 is briefly depressed manually, and energizing current flows through relay winding 47, via switches 10, 43*a*, 46*a*, 39, 48 and 45*c*.

9. Energization of relay winding 47 results in closing of self-locking switch 47*a*, which accordingly maintains winding 47 energized even after momentary switch 49 reopens.

10. A further result of the energization of relay winding 47 in step [8] is the closing of relay switch 47*b*. As a result, electromagetic valve 13 is energized (opens), and the flow of thinning fluid through conduit 1 into supply tank 14 commences, in the manner already described with respect to FIG. 1. The underpressures created in the constricted portions of conduit 1 draw the concentrates out of the punctured containers accommodated in holding units 6, 7, 8.

11. The pressure control valve 2 has previously been so adjusted that the time required for the three concentrate-containing containers to be completely emptied is substantially less than the further time required for thinning fluid to continue to flow into tank 14 to raise the liquid level therein to that associated with switch 39.

12. When the liquid level in tank 14 reaches that associated with switch 39, the switch 39 moves to its non-illustrated position.

13. As a result, relay winding 45 becomes energized by a current flowing through switches 10, 43*a*, 46*a* and 39.

14. As a further result of the moving of switch 39 to its non-illustrated position in step [12], the relay winding 47 becomes deenergized.

15. Consequently, the associated relay switch 47*a* opens thereby terminating the self-locking action, and relay switch 47*b* opens thereby deenergizing (closing) electromagnetic valve 13. Accordingly, the flow of fluid into the supply tank 14 terminates.

16. The energization of relay winding 45 in step [13] results in opening of relay switch 45*a*, and consequent deenergization of relay winding 46.

17. As a further result of the energization of relay winding 45 in step [13], the associated relay switch 45*b* closes, establishing a self-locking action with respect to the energization of relay winding 45. The self-locking action is as follows: Since the liquid level is higher than that of switch 39, it is evidently also higher than that of switch 38, which has remained in its non-illustrated position (energizing relay 43) ever since step [6]. Consequently, a second path for the flow of energizing current through winding 45 is established, via self-locking relay switch 45*b* and switch 38. Accordingly, when the first energizing current path, namely the one through switch 39, is broken as soon as the liquid level falls below the level associated with switch 39 as fluid is drawn out of the supply tank 14, there still exists the second energizing current path just mentioned, so that there is a self-locking action with respect to the energization of relay winding 45.

18. As a further result of the energization of relay winding 45 in step [13], the associated relay switch 45*d* closes. Accordingly, if the operator of the apparatus now manually closes switch 51, operation of the dosing pump 17 will commence.

19. As fluid is drawn out of the tank 14, the liquid level therein lowers. So long as the liquid level remains intermediate the levels associated with the two switches 39, 38, the relay winding 43 (energized in step [6]) remains energized, and the relay winding 45 (energized in step [13]) remains energized.

20. However, when the liquid level in tank 14 falls below the level associated with switch 38, switch 38 reassumes its illustrated position, thereby deenergizing the relay windings 43 and 45 and energizing the alarm 44.

21. As a result of deenergization of relay winding 45 in step [20], the associated relay switch 45*d* opens, thereby preventing further operation of the dosing pump 17 and thus preventing further lowering of the liquid level in the supply tank 14.

22. As a further result of deenergization of relay winding 45 in step [20], the associated relay switch 45*a* closes, thereby reenergizing relay winding 46, since the microswitch 10 is still closed by reason of the accommodation within holding unit 8 of a container, albeit an empty one. However, energization of relay winding 46 and opening of associated switch 46*a* at this stage of the operation does not affect other portions of the circuit. Accordingly, the only relay winding which is still energized is winding 46, and the only switches still in their non-illustrated positions are switches 10 and 46*a*. Thus, the circuit is in the same condition as just before the completion of step [5], and the entire cycle can be repeated starting with that step.

Figure 5:
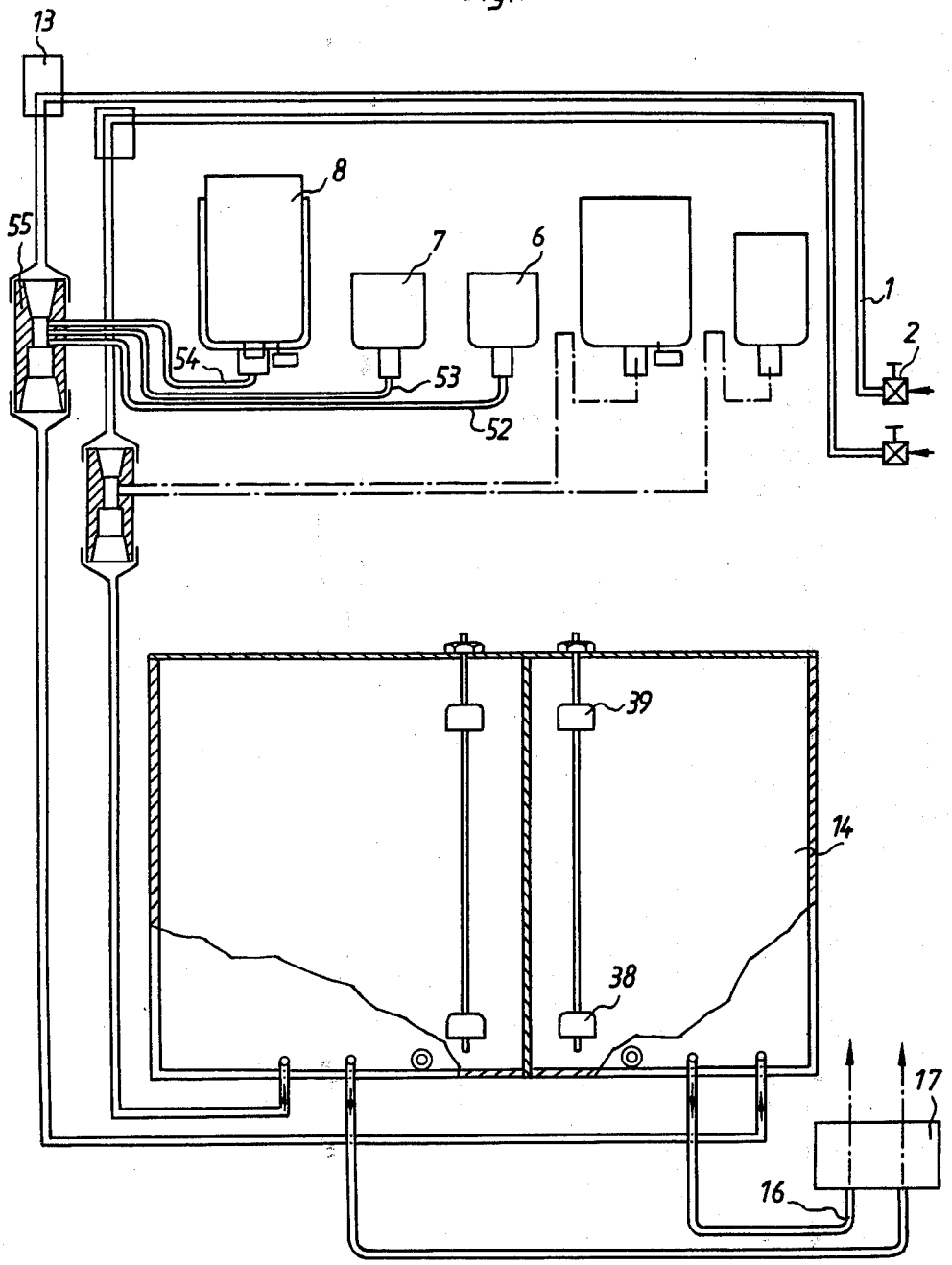
FIG. 5 depicts a mixing apparatus wherein the mixing of the concentrates and thinning fluid is performed inside a water jet pump.

FIG. 5 depicts another possible construction which is similar in many respects to that of FIG. 4. In FIG. 5, however, the holding units 6, 7, 8 for the concentrate-containing cans are connected not to a mixing conduit, but instead they are connected via respective conduits 52, 53, 54 to the inlet of a water jet pump 55. The suction inlet of the pump is located at a level higher than the level of the outlets of the holding units 6, 7, 8. As before, a second such mixing arrangement is provided for mixing the concentrates and thinning fluid which together form the fixing fluid; this second mixing arrangement is comprised of components not identified by reference numerals in FIG. 5. It is to be noted that the two conduits connecting the two additional holding units to the additional water jet pump also have humps in them, to prevent a free emptying of the fluid contents of the two additional holding units.

The joint emptying of the contents of holding units 6, 7, 8, via conduits 52, 53, 54, into a single pump inlet, calls for the use of conduits 52, 53, 54 having such flow cross sections that the cans in holding units 6, 7, 8, although of differing volume, empty in substantially the same time. In general, components in FIG. 5 corresponding to those depicted in FIGS. 1 and 4 are identified by the same reference numerals as employed in FIGS. 1 and 4.

The arrangement depicted in FIG. 5 is controlled by the control circuit depicted in FIG. 6, the operation of which has already been explained with respect to FIG. 4. The FIG. 5 arrangement operates in the same manner as the FIG. 4 arrangement, except that the concentrates in the holding units 6, 7, 8 are drawn up by suction to a level higher than the level of the outlets of holding units 6, 7, 8 and the mixing of the concentrates with water takes place directly in the water jet pump 55.

Figure 7:
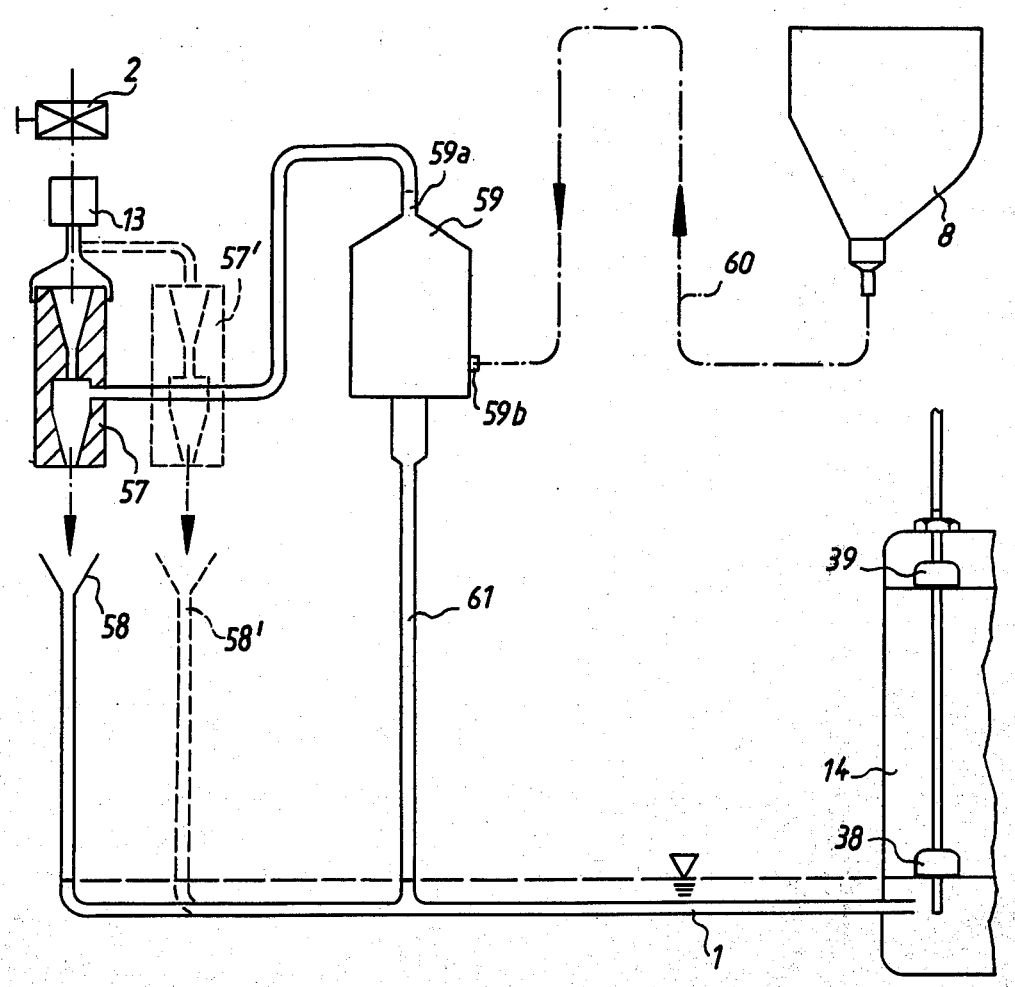
FIG. 7 depicts a mixing apparatus provided with a plurality of water jet pumps and associated suction chambers.

With the above described arrangements, it is assumed that the requirements of local water ordinances are met by providing an arrangement for preventing backflow and a pipe venting arrangement. However, in some localities recental enacted water ordinances require a free inflow of water into the container actually containing the impure or polluted water. The connection of a water jet pump to a tank containing polluted water is sometimes permissible only under special circumstances. In FIG. 7 there is depicted an arrangement which takes into account such strict local water ordinances.

In the FIG. 7 arrangement, there is provided a manually controllable valve 2 directly connected to a municipal water supply pipe, followed by an electromagnetically activatable valve 13. Connected to valve 13 is a water jet pump 57 the outlet of which communicates via an open inlet with a funnel-shaped inlet opening 58 for the mixing pipe 1. Connected to the suction side of the water jet pump is a suction chamber 59 the volume of which is so selected that the total volume of concentrates contained in the holding arrangement 8 can be emptied into the suction chamber 59. The provision of the connection port 59*a* for the water jet pump suction conduit at the upper end of the suction chamber 59 practically eliminates the possibility of the chemical concentrate being sucked into the water jet pump. The port 59*b* for the connecting conduit 60 leading to the holding arrangement 8 is located at a level substantially lower than the level of port 59*a*. The connecting conduit 60 has a hump intermediate the holding arrangement 8 and the port 59*b*, the hump being so selected that concentrate contained in the holding arrangement 8 cannot freely flow into the suction chamber 59. The suction chamber 59 is connected at the bottom thereof and by means of a conduit 61 to the mixing pipe 1. The mixing pipe 1 empties into a supply tank 14, provided with two level-detecting switches 38, 39, as in the embodiment of FIG. 4. The lower level-detecting switch 38 acts to prevent lowering of the liquid in the tank 14 below the associated level, thereby preventing the entrance of air into the mixing pipe 1. The upper level-detecting switch 39 determines, in consequence of its distance from the lower switch 38, the total volume of regenerating fluid to be produced during one mixing operation.

Concentrates which in unthinned form can be mixed together, can be jointly introduced into the suction chamber 59. In that case, the suction chamber 59 would require two or more separate ports 59*b*, each connected to a respective one of two holding arrangements. In that case, the volume of the suction chamber 59 must be increased, in correspondence to the total volume of the concentrates contained in the plurality of thusly connected holding arrangements.

If the individual chemical concentrates in unthinned form are not compatible, i.e., cannot be mixed together, then the water passing through magnet valve 13 is divided among two or more water jet pumps 57, 57′, etc., each such water jet pump being connected to way of a respective inlet conduit 58, 58′, etc., to the mixing pipe 1. Likewise, each such water jet pump 57, 57′, etc., will be connected to a respective one of a corresponding plurality of suction chambers, each of the plurality of suction chambers being connected to a corresponding holding arrangement for the respective concentrate.

The energization of the solenoid valve 13 is controlled by the switches 38, 39 and the associated control circuitry shown in FIG. 6 in the same manner as already described with respect to other embodiments. Accordingly, only the actual flow process will be described, with respect to FIG. 7.

At the beginning of the mixing operation, the liquid level in supply tank 14 is at the level associated with level-detecting switch 38. The holding unit 8 is assumed to contain one or more inverted concentrate-containing cans open at the bottom. The concentrate in the holding unit stands at a level preventing further emptying of the concentrate-containing cans. If now the magnet valve 13 is opened, water flows through the water jet pump 57 and through the funnel 58 into the mixing pipe 1. As a result, air is sucked out of the suction chamber 59, so that an underpressure is established in the suction chamber 59. As soon as this underpressure is of sufficient strength to pull the concentrate in holding arrangement 8 over the hump in conduit 60, the concentrate flows into the suction chamber 59. As a further result of the establishment of underpressure in chamber 59, fluid is sucked upwards out of the mixing pipe 1 through the conduit 61. However, this fluid rise terminates when the fluid level in conduit 61 is at a height corresponding to the height of the hump in conduit 60. Moreover, since the height of this hump is less than the height difference between the level-detecting switch 38 and the bottom of the suction chamber 59, the fluid initially drawn upwards through conduit 61 in this manner does not actually reach the suction chamber 59. On the contrary, the concentrate entering the suction chamber 59 travels downwards through the conduit 61, displacing the fluid initially sucked up into conduit 61, and finally reaches the mixing pipe 1, the concentrate becoming mixed therein with the water supplied by the water jet pump.

The volumetric flow rate of fluid through the pump 57 and the suction chamber 59, determined by the pumping capacity and the flow cross sections, is so chosen that the concentrate-containing can in the holding arrangement 8 is completely emptied before the liquid level in supply tank 14 reaches the level associated with switch 39. This means that towards the end of the mixing operation, air is sucked out of the holding arrangement 8, thereby terminating the existance of underpressure in suction chamber 59. As a result, the liquid column in conduit 61 sinks down to the level of the liquid in the supply tank 14. When a plurality of such holding units are employed in conjunction with a plurality of such water jet pumps, the emptying of the concentrate-containing cans proceeds analogously. The use of a plurality of water jet pumps avoids the difficulty of so dimensioning the relatively small openings of the various conduits as to establish respective emptying rates for the different holding units so matched to the different volumes of the different holding units that all the holding units become emptied at substantially the same time. Instead, with a plurality of water jet pumps, it is simply necessary to properly select the pumping capacity of the water jet pump or its dimensions in known manner. It is particularly advantageous that in the connecting conduit between the port 59a and the water jet pump there is no flow of concentrates, only an air flow, so that there will be no crystallization of chemicals in this conduit.

When the mixture in the supply tank 14 reaches the level of switch 39, the control circuitry of FIG. 6 causes the magnet valve 13 to close, thereby terminating the flow of water. The mixing operation ends.

Figure 8:
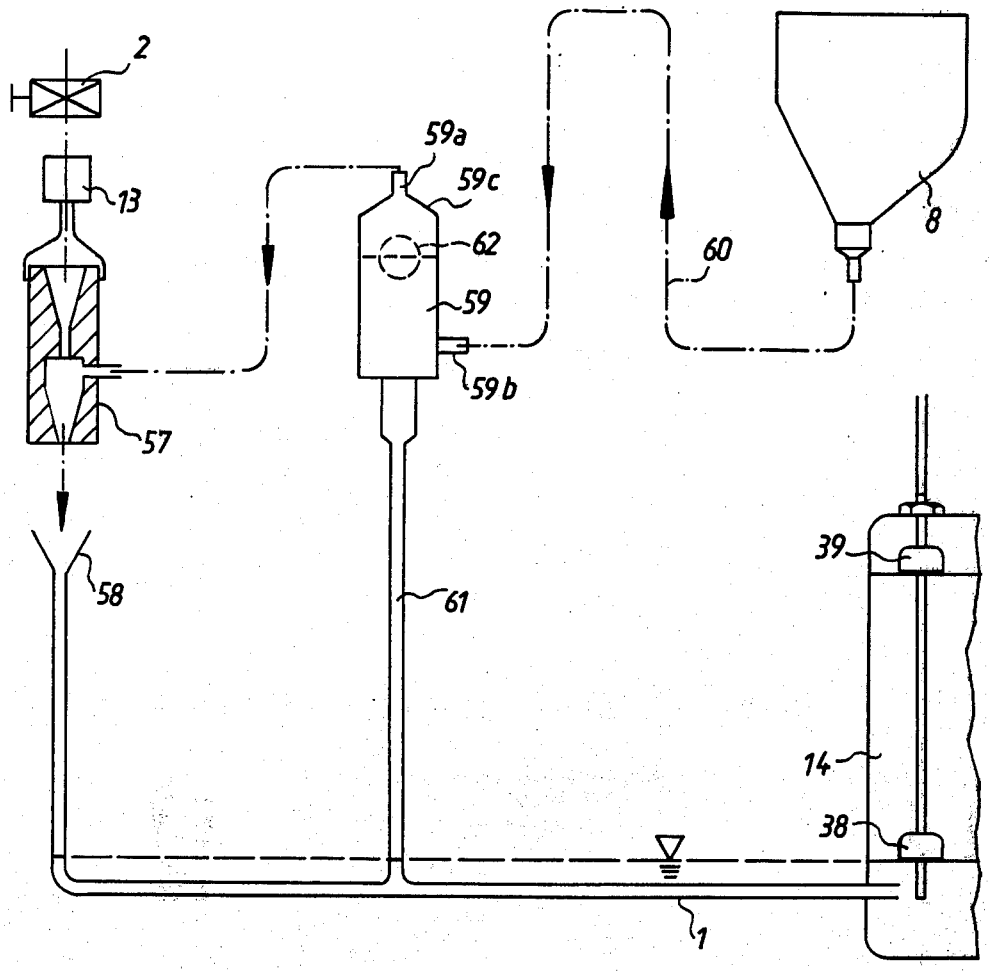
FIG. 8 depicts a modification of the apparatus shown in FIG. 7, using a smaller suction chamber.

A modification of the FIG. 7 arrangement is depicted in FIG. 8. Whereas in FIG. 7 the volume of the suction chamber 59 had to be substantially equal to the volume of concentrate contained in the associated holding unit 8, in the FIG. 8 arrangement the volume of suction chamber 59 will eventually cause the floating valve ball upper portion 59*c* of suction chamber 59 is configurated as a valve seat for a floating valve ball 62. Accordingly, during the mixing operation, if the sucking of concentrate out of the holding unit 8 is proceeding faster than the flow of concentrate down through conduit 61, the rise of the concentrate level in suction chamber 59 will eventially cause the floating valve ball 62 to rise into contact with the valve seat 59*c*, thereby closing off the suction conduit leading to the water jet pump 57. As a result, the underpressure in suction chamber 59 will end, and no more concentrate will be sucked out of the holding unit 8; on the other hand, the concentrate already in suction chamber 59 will continue to flow downwards through conduit 61 into mixing pipe 1. After a while, the liquid level in suction chamber 59 will descend, the floating valve ball 62 will descend, the underpressure in chamber 59 will be reestablished, and the sucking of concentrate out of the holding unit 8 will resume. In this way, the volume of the suction chamber 59 can be markedly decreased, compared to the embodiment of FIG. 7, so that the suction chamber 59 can be more conventiently located.

Figure 9:
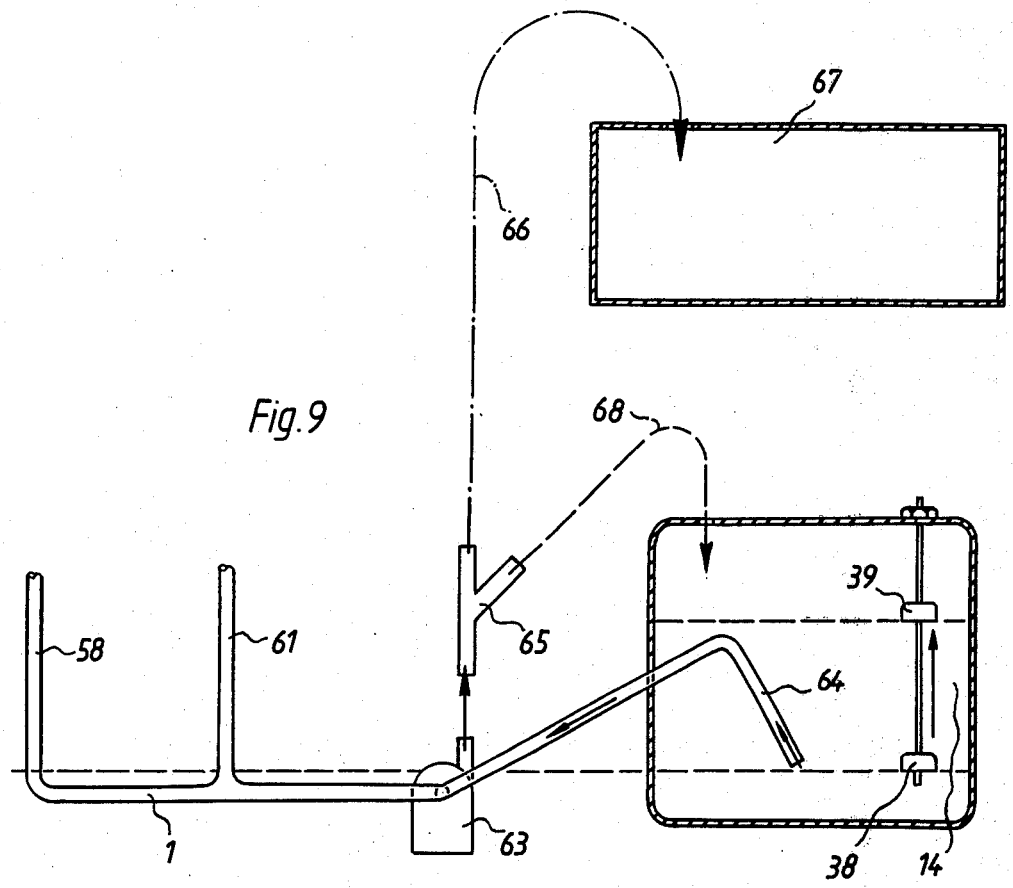
FIG. 9 depitcs a modification of a portion of the apparatuses shown in FIGS. 7 and 8.

FIG. 9 depicts a further modification of the arrangement depicted in FIG. 7. Corresponding parts are identified by corresponding reference numerals. The mixing conduit 1 in FIG. 9 does not empty directly into the tank 14, but instead is connected to the suction side of a centrifugal pump 63. Also connected to the suction side of the pump 63 is a pipe 64 leading out from inside the tank 14. This pipe is provided with a bend, the highest point of which is just slightly below the level of the switch 39. Connected to the pressure side of pump 63 is a three-port two-position valve 65 operative for connecting the pressure side of the pump 63 either to a conduit 66 leading to a regeneration tank 67 arranged in the developer machine or else to a conduit 68 leading into the tank 14.

The operation of the embodiment shown in FIG. 9 is as follows:

During the mixing operation, so long as concentrate from the holding units and water from the water jet pump 57 enter the mixing conduit 1, the pump 63 pumps the mixture through the conduit 68 into the supply tank 14. Accordingly, the liquid level in tank 14 steadily rises until it reaches the highest point of bent pipe 64. From then on, mixture in the tank 14 is sucked out of the tank 14 through pipe 64, and then returned to the tank 14 via conduit 68. This results in additional mixing action. Upon termination of the supply of water as a result of the closing of valve 13, and after elapse of a further mixing time for the recirculation of the fluid in tank 14 in the manner just described, the valve 65 is moved to its other position, blocking the conduit 68 and opening the conduit 66. As a result, the mixture will be pumped up into the tank 67, so that with a corresponding proportioning of the volumes, the next mixing operation can be performed during the operation of the developer machine.

Figure 10:
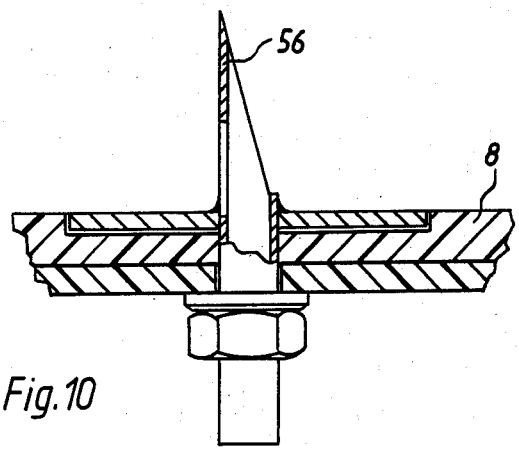
FIG. 10 depicts an arrangement for causing concentrate to flow out of a cannister.

FIG. 10 depicts a hollow can-puncturing member which can be provided inside the holding unit 8, at the bottom of the latter. The can-puncturing member 56 is truncated by an inclined plane. It serves to puncture the relatively thinwalled concentrate-containing can when such can is inserted into the holding unit 8 and pushed down against the puncturing member 56. In this way, the opening of the concentrate-containing can and the initiation of the emptying of the can can be very quickly performed, without a time-consuming opening of screw-on lids, or the like. As already explained with respect to FIG. 1, instead of such a hollow puncturing member 56, use can be made of a knife blade member 9 having a cutout section at its bottom, so as not to impede the outflow of fluid. When such a knife blade member is employed, the entire lower part of the concentrate-containing can is split open.

Self-evidently a greater or lesser number of holding units and concentrate-containing cans may be employed. Also, each of the holding units can be provided with a can-detecting switch 10, the switches in such case being connected in series. For the level-detecting switches and the volumetric flowmeter, use can be made of any of the known devices for performing the functions in question.

Advantageously, the volumetric flow rates of the thinning fluid and of the concentrates are so selected relative to each other that the required amount of thinning fluid passes through the mixing conduit in a time approximately 30% greater than the time required for the holding units to become emptied.

It will be understood that each of the elements described above, or two or more together, may also find a useful application in other types of circuits and constructions differing from the type described above.

While the invention has been illustrated and described as embodied in an arrangement for mixing fluids in a photographic processing arrangement, and in a method of mixing fluids in a photographic processing arrangement, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of mixing at least one liquid chemical concentrate with a thinning fluid to form a predetermined amount of a mixture or solution having a predetermined composition, particularly for use in photographic processing, comprising, in combination, the steps of placing a predetermined amount of said at least one liquid concentrate into at least one respective holding unit; substantially completely emptying the contents of the holding unit into a mixing conduit leading to a supply tank while passing thinning fluid through the mixing conduit; and terminating the flow of thinning fluid through the mixing conduit when the amount of thinning fluid which has been passed through the mixing conduit reaches an amount corresponding to said predetermined amount of said concentrate and to said predetermined composition.

2. A method as defined in claim 1, wherein said step of terminating the flow of thinning fluid through the mixing conduit comprises blocking off a thinning-fluid-supply conduit.

3. A method as defined in claim 1, wherein said step of placing a predetermined amount of said at least one liquid concentrate into at least one respective holding unit comprises the step of placing predetermined amounts of a plurality of liquid concentrates into a plurality of respective holding units, and wherein said step of emptying comprises substantially completely emptying the contents of the plurality of holding units into the mixing conduit while passing thinning fluid through the mixing conduit, and wherein said step of terminating comprises terminating the flow of thinning fluid through the mixing conduit when the amount of thinning fluid which has been passed through the mixing conduit reaches the amount corresponding to said predetermined amounts of said plurality of concentrates and said predetermined composition.

4. A method as defined in claim 3, the plurality of holding units respectively accommodating different volumes of respective concentrates, and wherein said step of emptying comprises simultaneously initiating the emptying of the contents of the plurality of holding units into the mixing conduit and emptying the contents of the plurality of holding units at respective volumetric flow rates such that the plurality of holding units become emptied at substantially the same time.

5. A method as defined in claim 4, wherein said step of emptying further comprises the step of initiating the passage of thinning fluid through the mixing conduit simultaneously with the initiation of the emptying of the holding units, and wherein said step of passing thinning fluid through the mixing conduit comprises passing thinning fluid through the mixing conduit at such a volumetric flow rate that the required amount of thinning fluid passes through the mixing conduit in a time at least equal to the time required for the holding units to become emptied.

6. A method as defined in claim 5, wherein the volumetric flow rate of the thinning fluid is such that the required amount of thinning fluid passes through the mixing conduit in a time approximately 30% greater than the time required for the holding units to become emptied.

7. A method as defined in claim 5, wherein said step of terminating the flow of thinning fluid through the mixing conduit comprises detecting the amount of the mixture or solution in the tank and terminating the flow of thinning fluid through the mixing conduit when the amount of the mixture or solution in the tank reaches said predetermined amount thereof.

8. A method as defined in claim 4, wherein said step of emptying the contents of the plurality of holding units into the mixing conduit comprises uninterruptedly emptying the contents of each holding unit into the mixing conduit at a rate physically dependent upon the volumetric flow rate of fluid flowing through the mixing conduit, and emptying the contents of the holding units gradually into different respective sections of the mixing conduit so that undiluted liquid concentrate from a plurality of the holding units cannot come into direct contact with each other.

9. A method as defined in claim 3, wherein said step of emptying the contents of the plurality of holding units into the mixing conduit comprises uninterruptedly emptying the contents of each holding unit into the mixing conduit at a rate physically dependent upon the volumetric flow rate of fluid flowing through the mixing conduit, and emptying the contents of the holding units gradually into spaced sections of the mixing conduit so that undiluted liquid concentrate from the plurality of holding units cannot come into direct contact with each other.

10. A method as defined in claim 3, wherein said step of emptying the contents of the plurality of holding units into the mixing conduit comprises gradually emptying the holding units into the mixing conduit at points of discharge which are spaced from each other so that undiluted liquid concentrate from the plurality of holding units cannot come into direct contact with each other.

11. A method as defined in claim 1, wherein said step of emptying comprises simultaneously initiating the flow of thinning fluid through said mixing conduit and the emptying of the contents of the holding unit, and further emptying the contents of the holding unit into the mixing conduit and passing the thinning fluid through the mixing conduit at such respective volumetric flow rates that the time required for the requisite amount of thinning fluid to pass through the mixing conduit is at least equal to the time required for the concentrate to pass through the mixing conduit.

12. A method as defined in claim 11, wherein the volumetric flow rates of the thinning fluid and the concentrate are such that the time required for the requisite amount of thinning fluid to pass through the mixing conduit is approximately 30% greater than the time required for the concentrate to pass through the mixing conduit.

13. A method as defined in claim 11, wherein said step of terminating the flow of thinning fluid through the mixing conduit comprises detecting the amount of the mixture or solution in the tank and terminating the flow of thinning fluid through the mixing conduit when the amount of the mixture or solution in the tank reaches said predetermined amount thereof.

14. A method as defined in claim 1, wherein the step of substantially completely emptying the contents of the holding unit comprises uninterruptedly emptying the contents of the holding unit.

15. A method as defined in claim 1, wherein the step of substantially completely emptying the contents of the holding unit comprises uninterruptedly emptying the contents of the holding unit at a rate physically dependent upon the volumetric flow rate of fluid flowing through the mixing conduit, whereby to assure that the liquid concentrate is added to the thinning fluid at a proper rate.

16. An arrangement for mixing at least one liquid chemical concentrate with a thinning fluid to form a predetermined amount of a mixture or solution having a predetermined composition, particularly for use in photographic processing, comprising, in combination, a supply tank to be filled with said mixture or solution; a mixing conduit emptying into said supply tank; at least one holding unit for holding a predetermined amount of at least one liquid chemical concentrate; and means for effecting substantially complete emptying of the liquid contents of said holding unit into said mixing conduit while passing thinning fluid through said mixing conduit, and for automatically terminating the flow of thinning fluid through said mixing conduit when the amount of thinning fluid which has been passed through said mixing conduit reaches an amount corresponding to said predetermined amount of said liquid concentrate and to said predetermined composition.

17. An arrangement as defined in claim 16, wherein arrangement includes a thinning-fluid supply conduit leading into said mixing conduit, and wherein said means comprises means for automatically terminating the flow of thinning fluid through said mixing conduit by blocking off said thinning-fluid supply conduit.

18. An arrangement as defined in claim 16, wherein said arrangement is comprised of a plurality of holding units for holding respective predetermined amounts of a respective liquid chemical concentrate, and wherein said means comprises means for effecting substantially complete emptying of the liquid contents of said plurality of holding units into said mixing conduit while passing thinning fluid through said mixing conduit, and for automatically terminating the flow of thinning fluid through said mixing conduit when the amount of thinning fluid which has been passed through said mixing conduit reaches the amount corresponding to said predetermined amounts of said concentrates and said predetermined composition.

19. An arrangement as defined in claim 18, wherein said plurality of holding units are adapted to accommodate different respective volumes of the respective concentrates, and wherein said means for effecting emptying comprises means for simultaneously initiating the emptying of the contents of said holding units into said mixing conduit, and means for causing the emptying of said holding units to proceed at respective volumetric flow rates such that said holding units become emptied at substantially the same time.

20. An arrangement as defined in claim 19, wherein said means for effecting emptying comprises means for initiating the passage of thinning fluid through said mixing conduit simultaneously with the initiation of the emptying of said holding units, and means for causing the passing of thinning fluid through said mixing conduit to proceed at volumetric flow rate such that the required amount of thinning fluid passes through the mixing conduit in a time at least equal to the time required for the holding units to become emptied.

21. An arrangement as defined in claim 20, wherein the volumetric flow rate of said thinning fluid is such that the required amount of thinning fluid passes through the mixing conduit in a time approximately 30% greater than the time required for the holding units to become emptied.

22. An arrangement as defined in claim 20, wherein said means for effecting emptying of the contents of said holding unit into said mixing conduit while passing thinning fluid through said mixing conduit and for automatically terminating the flow of thinning fluid through said mixing conduit comprises means for detecting the amount of the mixture or solution in said tank and terminating the flow of thinning fluid through said mixing conduit when the amount of the mixture or solution in said tank reaches said predetermined amount thereof.

23. An arrangement as defined in claim 16, wherein said means comprises means for simultaneously initiating the flow of thinning fluid through said mixing conduit and the emptying of the contents of said holding unit, and means for causing the emptying of the contents of said holding unit into said mixing conduit and the passing of thinning fluid through said mixing conduit to proceed at such respective volumetric flow rates that the time required for the requisite amount of thinning fluid to pass through the mixing conduit is at least equal to the time required for the concentrate to pass through the mixing conduit.

24. An arrangement as defined in claim 23, wherein the volumetric flow rates of the thinning fluid and of the concentrate are such that the time required for the requisite amount of thinning fluid to pass through the mixing conduit is approximately 30% greater than the time required for the concentrate to pass through the mixing conduit.

25. An arrangement as defined in claim 23, wherein said means for effecting emptying of the contents of said holding unit into said mixing conduit while passing thinning fluid through said mixing conduit and for automatically terminating the flow of thinning fluid through said mixing conduit comprises means for detecting the amount of the mixture or solution in said tank and terminating the flow of thinning fluid through said mixing conduit when the amount of the mixture or solution in said tank reaches said predetermined amount thereof.

26. An arrangement as defined in claim 18, wherein said means comprises means for preventing the initiation of flow of thinning fluid through said mixing conduit when no concentrate is present in one of said holding units.

27. An arrangement as defined in claim 18, wherein each of said holding units is configurated as a container open at the top to permit insertion thereinto of a concentrate-containing cannister, and wherein each of said holding units is provided at the bottom of the interior thereof with a puncturing member for puncturing such cannister when the latter is inserted into the holding unit.

28. An arrangement as defined in claim 18, wherein said means for effecting substantially complete emptying of the liquid contents of said plurality of holding units into said mixing conduit comprises means for effecting uninterrupted emptying of the contents of each holding unit into the mixing conduit at rates physically dependent upon the volumetric flow rate of fluid flowing through the mixing conduit, the points of discharge of the holding units into the mixing conduit being spaced from each other so that undiluted liquid concentrate from the plurality of holding units cannot come into direct contact with each other.

29. An arrangement as defined in claim 18, wherein said means for effecting substantially complete emptying of the liquid contents of said holding units comprises means for discharging the liquid contents of the holding units into said mixing conduit at points of discharge which are spaced from each other so that undiluted liquid concentrate from the plurality of holding units cannot come into direct contact with each other.

30. An arrangement as defined in claim 16, wherein said arrangement includes a branched thinning-fluid-supply conduit having one branch forming part of said mixing conduit and another branch leading into said holding unit for the emptying of the contents of said holding unit into said thinning-fluid-supply conduit.

31. An arrangement as defined in claim 16, wherein said mixing conduit is generally horizontally disposed and has a downstream end emptying into said supply tank and an upstream end connected to a thinning-fluid-supply conduit, and wherein said arrangement includes a plurality of holding units having outflow openings discharging into said mixing conduit, and wherein said means comprises means for effecting interdependent blocking and unblocking of said thinning-fluid-supply conduit and of said outflow openings.

32. An arrangement as defined in claim 31, wherein said means for effecting interdependent blocking and unblocking of said thinning-fluid-supply conduit and of said outflow openings of said holding units comprises an electromagnetic valve in said thinning-fluid-supply conduit and electromagnetic means for unblocking said outflow openings, said electromagnetic valve and said electromagnetic means comprising respective first and second electromagnets, a relay comprised of a relay winding and two normally-open relay switches, and first and second level-responsive switches which each close when the liquid level in said tank falls below respective lower and higher levels, one of said normally open relay switches being connected in the current path of said first electromagnet, said second level-responsive switch being connected in the current path of said first electromagnet, said first level-responsive switch being connected in the current path of said relay winding, and the other of said normally open relay switches being connected in the current path of said electromagnet.

33. An arrangement as defined in claim 32, wherein said means for effecting interdependent blocking and unblocking of said thinning-fluid-supply conduit and of said outflow openings further comprises two cooperating switches respectively connected in the current path of said second electromagnet and in the current path of said first level-responsive switch, and wherein said electromagnetic means for unblocking said outflow openings comprises a container puncturing apparatus comprised of puncturing members for puncturing concentrate-containing containers accommodated in said holding units, said puncturing apparatus having a cocked position in which it is electromagnetically cocked with said puncturing members in non-puncturing position and in which said two control switches are in positions permitting current flow through said second electromagnet and said relay winding, and an uncocked or released position resulting from deenergization of said second electromagnet, in which said puncturing members are in puncturing position and in which said control switches interrupt the current paths of said relay winding and said second electromagnet.

34. An arrangement as defined in claim 33, wherein said arrangement further includes a warning arrangement, and wherein at least one of said control switches closes the current path of said warning arrangement when said control switches are in the position thereof interrupting the current paths of said relay winding and said second electromagnet.

35. An arrangement as defined in claim 16, wherein said mixing conduit is comprised of a generally horizontally disposed portion having a downstream end emptying into said supply tank and an upstream end connected to a thinning-fluid-supply conduit, and wherein said arrangement includes a plurality of holding units having outflow openings discharging directly into said mixing conduit, and wherein said means comprises valve means downstream of said holding units for blocking and unblocking said mixing conduit, and wherein each of said outflow openings is provided with a conduit discharging into said mixing conduit and provided with a check valve operative for permitting flow of concentrate out of the respective holding unit into the mixing conduit only when the pressure inside said mixing conduit is lower than the pressure inside the respective holding unit.

36. An arrangement as defined in claim 35, wherein the junctions between said horizontal portion of said mixing conduit and the conduits communicating with the outflow openings of said holding units are each configurated in the form of a water jet pump.

37. An arrangement as defined in claim 16, and further including a regeneration tank and a pump having an inlet and an outlet, said mixing conduit being connected at its downstream end to said inlet, and further including a three-port two-position valve having an inlet connected to said outlet of said pump and having a first outlet connected to said supply tank and a second outlet connected to said regeneration tank, and further including a recirculation conduit having an outlet connected to said inlet of said pump and having an inlet communicating with the interior of said supply tank.

38. An arrangement as defined in claim 16, wherein said means for effecting substantially complete emptying of the liquid contents of said holding unit comprises means for effecting uninterrupted emptying of the liquid contents of the holding unit into the mixing conduit.

39. An arrangement as defined in claim 16, wherein said means for effecting substantially complete emptying of the liquid contents of said holding unit comprises means for effecting uninterrupted emptying of the liquid contents of the holding unit into the mixing conduit at a rate physically dependent upon the volumetric flow rate of the fluid flowing through the mixing conduit, whereby to assure that the liquid concentrate is added to the thinning fluid at a proper rate.

40. An arrangement for mixing at least one chemical concentrate with a thinning fluid to form a predetermined amount of a mixture or solution having a predetermined composition, particularly for use in photographic processing, comprising, in combination, a supply tank to be filled with said mixture or solution; a mixing conduit emptying into said supply tank; at least one holding unit for holding a predetermined amount of at least one chemical concentrate; and means for effecting substantially complete emptying of the contents of said holding unit into said mixing conduit while passing thinning fluid through said mixing conduit, and for automatically terminating the flow of thinning fluid through said mixing conduit when the amount of thinning fluid which has been passed through said mixing conduit reaches an amount corresponding to said predetermined amount of said concentrate and to said predetermined composition, wherein said arrangement is comprised of a plurality of holding units for holding respective predetermined amounts of a respective chemical concentrate, and wherein said means comprises means for effecting substantially complete emptying of the contents of said plurality of holding units into said mixing conduit while passing thinning fluid through said mixing conduit, and for automatically terminating the flow of thinning fluid through said mixing conduit when the amount of thinning fluid which has been passed through said mixing conduit reaches the amount corresponding to said predetermined amounts of said concentrates and said predetermined composition, wherein said mixing conduit is comprised of a water jet pump having a suction inlet, and wherein each of said holding units has an outflow opening located at a level lower than the level of said suction inlet, and conduits connecting the respective outflow openings of said holding units to said suction inlet.

41. An arrangement for mixing at least one chemical concentrate with a thinning fluid to form a predetermined amount of a mixture or solution having a predetermined composition, particularly for use in photographic processing, comprising, in combination, a supply tank to be filled with said mixture or solution; a mixing conduit emptying into said supply tank; at least one holding unit for holding a predetermined amount of at least one chemical concentrate; and means for effecting substantially complete emptying of the contents of said holding unit into said mixing conduit while passing thinning fluid through said mixing conduit, and for automatically terminating the flow of thinning fluid through said mixing conduit when the amount of thinning fluid which has been passed through said mixing conduit reaches an amount corresponding to said predetermined amount of said concentrate and to said predetermined composition, wherein said mixing conduit is comprised of a water jet pump having a suction inlet and having an outlet and a conduit portion downstream of said water jet pump having a funnel-shaped open inlet for receiving fluid discharged from the outlet of said water jet pump, and wherein said means includes a suction chamber having an outlet connected to said suction inlet, having an inlet connected to the outlet of said holding unit by means of a conduit comprised of a humped portion preventing free flow of the contents of said holding unit into said suction chamber, and wherein said suction chamber has a further outlet communicating with a portion of said mixing pipe located at a level lower than that of said further outlet of said suction chamber.

42. An arrangement as defined in claim 41, wherein the volume of said suction chamber is substantially equal to the volume of concentrate which said holding unit is adapted to accommodate.

43. An arrangement as defined in claim 41, wherein said outlet of said suction chamber communicating with said suction inlet communicates with said suction chamber at the upper portion of the latter, and wherein said suction chamber comprises a floating valve ball operative when lifted by fluid in said suction chamber for blocking communication between said suction chamber and said suction inlet.

44. An arrangement for mixing at least one chemical concentrate with a thinning fluid to form a predetermined amount of a mixture or solution having a predetermined composition, particularly for use in photographic processing, comprising, in combination, a supply tank to be filled with said mixture or solution; a mixing conduit emptying into said supply tank; at least one holding unit for holding a predetermined amount of at least one chemical concentrate; and means for effecting substantially complete emptying of the contents of said holding unit into said mixing conduit while passing thinning fluid through said mixing conduit, and for automatically terminating the flow of thinning fluid through said mixing conduit when the amount of thinning fluid which has been passed through said mixing conduit reaches an amount corresponding to said predetermined amount of said concentrate and to said predetermined composition, wherein said means comprises in said supply tank a lower level-detecting switch which controls a first relay to ready said arrangement for a mixing operation, and an upper level-detecting switch which controls a second relay, and an electromagnetic valve controlled by said second relay for controlling the flow of thinning fluid through said mixing conduit.

45. An arrangement as defined in claim 44, wherein said means further includes an activator switch for initiating the mixing operation, a third relay comprised of a relay winding and a relay switch, said relay switch being connected in parallel with said activator switch, said second relay being comprised of a relay winding and a normally closed relay switch, and further including a detector switch which closes when said holding unit contains chemical concentrate, said relay winding of said third relay being connected in series with said normally closed switch and in series with the parallel connection of said activator switch and said relay switch of said third relay, said upper level-detecting switch having a first position in which it connects said winding of said second relay in series with said detector switch and a second position in which it connects said detector switch in series with said normally closed switch and in series with said relay switch of said third relay and in series with said winding of said third relay.

46. An arrangement as defined in claim 44, wherein said second relay further includes a normally open self-locking relay switch which when closed connects in parallel the winding of said first and third relays.

47. An arrangement defined in claim 44, wherein said lower level-detecting switch is connected in the current path of said winding of said first relay and opens when the liquid level in said supply tank falls below the level associated with said lower level-detecting switch, thereby deenergizing said first relay and preventing performance of a mixing operation.

48. An arrangement as defined in claim 44, and further including an indicator unit in parallel with said winding of said second relay and another indicator unit in parallel with said winding of said third relay, and a warning unit, and wherein said lower level-detecting switch completes the current path of said warning unit when the liquid level in said supply tank falls below the level associated with said lower level-detecting switch.

* * * * *